US006155457A

United States Patent [19]

Landa et al.

[11] Patent Number: 6,155,457

[45] Date of Patent: Dec. 5, 2000

[54] DISPENSER APPARATUS ESPECIALLY FOR LIQUID TONER CONCENTRATE

[75] Inventors: Benzion Landa, Edmonton, Canada; Oded Sagiv, Cochav Yair, Israel

[73] Assignee: Indigo N.V., Rotterdam, Netherlands

[21] Appl. No.: 08/119,163

[22] PCT Filed: Mar. 26, 1991

[86] PCT No.: PCT/NL91/00049

§ 371 Date: Sep. 24, 1993

§ 102(e) Date: Dec. 23, 1993

[87] PCT Pub. No.: WO92/17824

PCT Pub. Date: Oct. 15, 1992

[30] Foreign Application Priority Data

Mar. 26, 1991 [WO] WIPO ..... PCT/NL91/00049

[51] Int. Cl.[7] ..... G03G 15/10; B65D 35/22; B65D 35/28; B67D 5/42

[52] U.S. Cl. ..... 222/94; 222/95; 222/386.5; 222/327; 399/238

[58] Field of Search ..... 222/94, 162, 386.5, 222/559; 355/256; 399/237, 238

[56] References Cited

U.S. PATENT DOCUMENTS

| | | | |
|---|---|---|---|
| 2,890,652 | 6/1959 | Jauch et al. | 222/386.5 X |
| 3,270,920 | 9/1966 | Nessler | 222/94 X |
| 3,651,782 | 3/1972 | MacDonald, Jr. . | |
| 3,789,794 | 2/1974 | Smith et al. . | |
| 3,940,031 | 2/1976 | Fishman | 222/386.5 |
| 4,098,434 | 7/1978 | Uhlig | 222/94 |
| 4,854,481 | 8/1989 | Bohl et al. | 222/94 |
| 5,004,123 | 4/1991 | Stoody | 222/94 |
| 5,024,355 | 6/1991 | Jouillat et al. | 222/162 |
| 5,208,637 | 5/1993 | Landa | 355/256 |

FOREIGN PATENT DOCUMENTS 0306217 3/1989 European Pat. Off. .

*Primary Examiner*—Fred L. Braun

*Attorney, Agent, or Firm*—Greenblum & Bernstein, P.L.C.

[57] ABSTRACT

Apparatus for dispensing liquid toner concentrate including a container containing liquid toner concentrate, mounting apparatus operative to secure the container while allowing for axial movement of the container and air pressure apparatus for causing axial movement of the container and movement of a movable partition in the canister to aid in selective dispensing of the liquid toner concentrate from the container.

25 Claims, 7 Drawing Sheets

DISPENSER APPARATUS ESPECIALLY FOR LIQUID TONER CONCENTRATE

FIELD OF THE INVENTION

The present invention relates generally to dispenser apparatus and more particularly to dispenser apparatus for liquid toner replenishment in imaging systems.

BACKGROUND OF THE INVENTION

Liquid toner compositions for use in liquid toner imaging systems normally comprise a carrier liquid and toner particles. These two components deplete at different rates from a liquid toner supply reservoir which is normally part of such systems. The relative component depletion rates are dependent on the percent coverage of the images produced by the imaging system and on other factors.

Imaging systems, be they printers or copiers, generally produce a variety of images having a wide range of print coverage. It is well known that the balance between the various components of a liquid toner can have a strong effect on the quality of printed images. Therefore most imaging systems have replenishment systems, which provide replenishment with toner concentrate, having a relatively high percentage of particles and also containing carrier liquid, and with carrier liquid free of toner particles. One or both of these replenishment components may have charge director added thereto, or charge director may be supplied in a separate charge director replenishment solution.

Toner concentrate is added whenever the liquid toner becomes depleted of toner particles. The concentration of toner particles may be determined by measuring the optical density of the liquid toner composition in the reservoir. Carrier liquid is supplied whenever the total amount of liquid toner in the reservoir falls below a certain level. Charge director may be added when the conductivity of the solution is reduced.

The carrier liquid supply generally includes apparatus for the measurement of the liquid level in the reservoir, and a series of pumps and/or valves which are operated in response to a signal from the measurement apparatus to replenish the carrier liquid in the reservoir by pumping or otherwise transporting carrier liquid from the carrier liquid replenishment supply.

An exemplary system for the replenishment of liquid toner components is described in U.S. Pat. No. 4,860,924, the disclosure of which is incorporated herein by reference.

U.S. Pat. No. 3,789,794 describes a replenishment system including a dispenser container for paste-like toner concentrate which utilizes a piston to force the paste out of the container. Movement of the piston is caused by a fluid under pressure at the back of the piston.

U.S. Pat. No. 4,355,736 describes a container for dispensing liquid or paste as an aerosol, using a plunger whose movement is caused by compressed gas.

In multi-color electrophotography systems, liquid toners of different colors are required, each having associated therewith a separate replenishment system for toner particle concentrate and for carrier liquid, including separate measurement and supply apparatus. These separate systems add expense and complication and reduce reliability.

SUMMARY OF THE INVENTION

The present invention seeks to provide improved dispenser apparatus for replenishment of liquid toner in imaging systems.

There is therefore provided liquid toner concentrate dispenser apparatus comprising:

a container containing liquid toner concentrate;

mounting means operative to secure the container while allowing for axial movement of the container; and air pressure means for causing axial movement of the container and selective dispensing of the liquid toner concentrate from the container.

In a preferred embodiment of the invention, the container containing liquid toner concentrate is a canister having a movable internal partition defining a first space containing the liquid toner concentrate and a second space between the movable partition and the canister; a first valve communicating with the first space for allowing egress of liquid toner concentrate from the first space when the first valve is activated; and a second valve communicating with the second space for allowing ingress of pressurized air into the second space when the second valve is activated.

In another preferred embodiment of the invention, the first valve is a push-type valve which is activated when depressed, and the second valve is a uni-directional pressure valve which is activated when the air pressure exterior to the second space is greater than the air pressure within the second space.

In another preferred embodiment of the invention, the container is a rigid enclosure having first and second communication openings in opposite ends thereof, and the first valve is disposed in the first communication opening and the second valve is disposed in the second communication opening.

In yet another preferred embodiment of the invention, the air pressure means activates the first valve by causing axial displacement of the container and forces pressurized air into the second space via the second valve.

In another preferred embodiment of the invention, the air pressure means includes a piston which is in operative association with the container, so that activation of the air pressure means causes axial displacement of the piston and the container, thereby causing activation of the first valve.

In yet another preferred embodiment of the invention, the piston is mounted on a spring which is operative to cause the piston to return to its rest position when the air pressure means is not activated.

In another preferred embodiment of the invention, the liquid toner concentrate is contained within a flexible envelope which is disposed within the canister.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
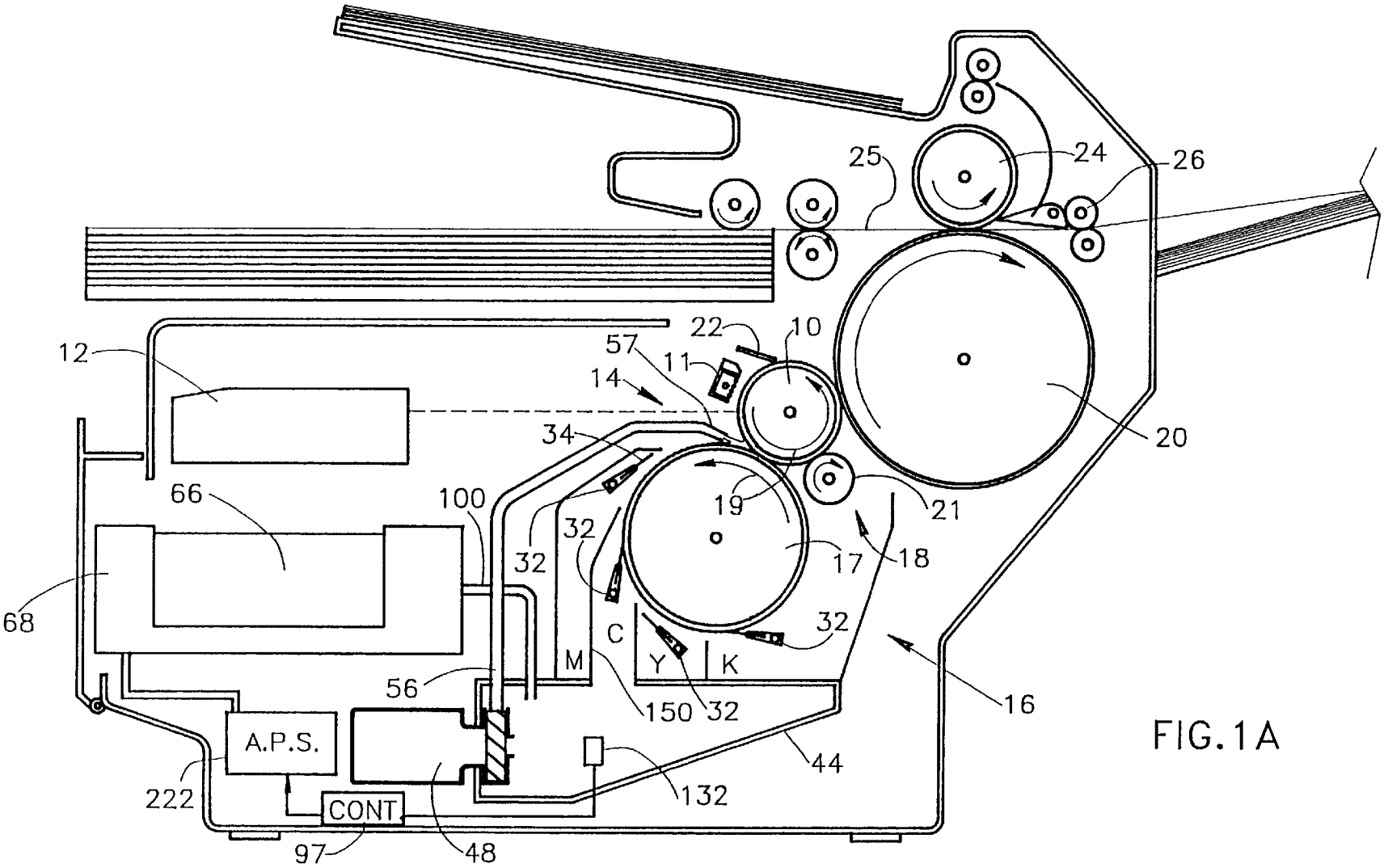
FIG. 1A is a side, partial sectional generalized illustration of multi-color imaging apparatus constructed and operative in accordance with a preferred embodiment of the present invention.
Figure 1B:
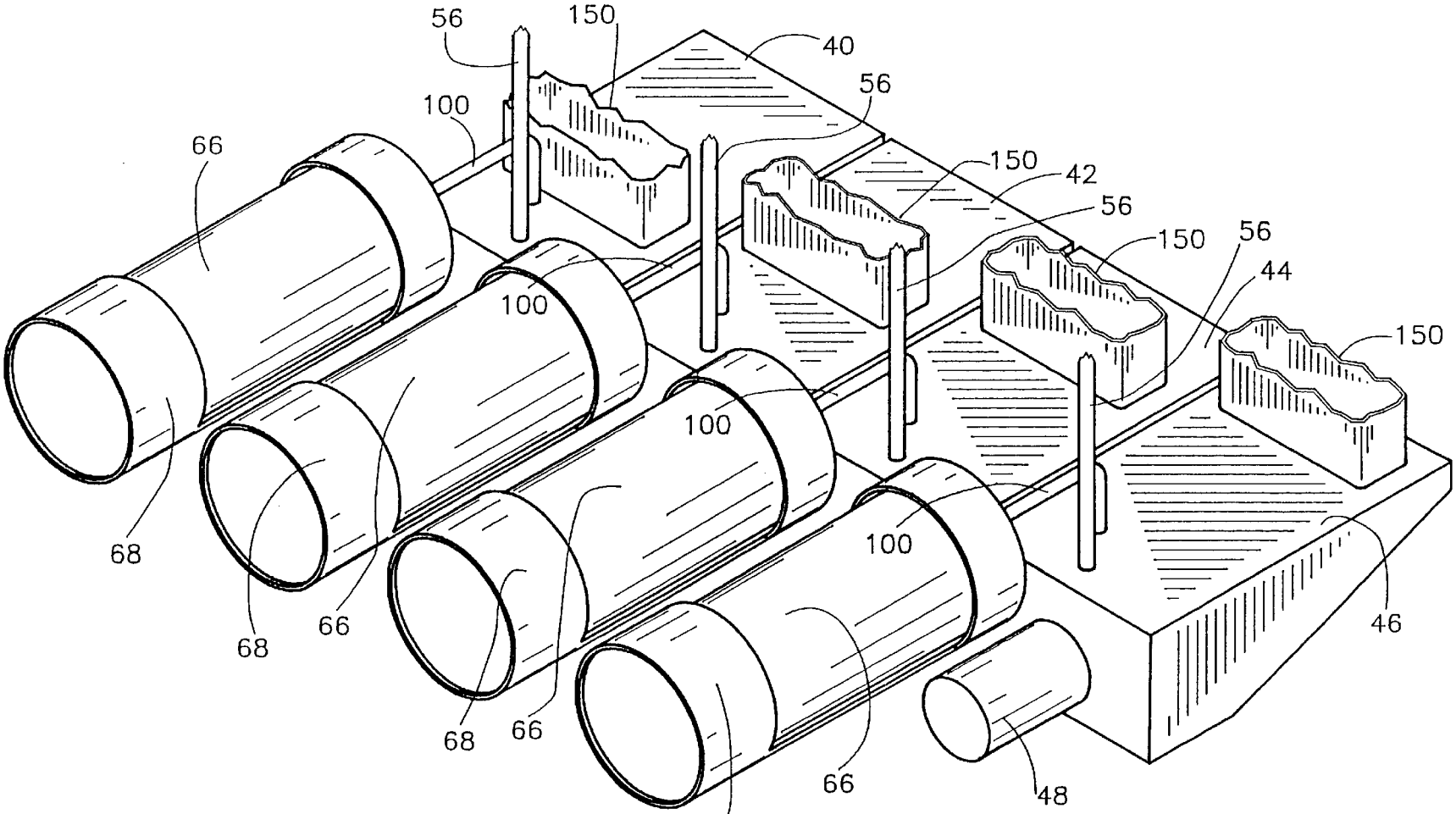
FIG. 1B is a partial perspective view of the apparatus of FIG. 1A.

Reference is now made to FIGS. 1A and 1B which illustrate multicolor electrostatic imaging apparatus constructed and operative in accordance with a preferred embodiment of the present invention. As seen in FIGS. 1A and 1B, there is provided an image bearing surface typically embodied in a rotating photoconductive drum 10. Operatively associated with photoconductive drum 10 is photoconductor charging apparatus 11 and imaging apparatus 12, for example a laser scanner, for providing a desired latent image on drum 10. The latent image normally includes image areas at a first electrical potential and background areas at another electrical potential.

Also associated with photoconductive drum 10 are a multicolor liquid developer assembly 16, an excess liquid removal assembly 18, an intermediate transfer member 20 and a toner cleaning station 22.

Developer assembly 16 preferably includes a developer roller electrode 17 spaced from photoconductive drum 10 and typically rotating in the same sense as drum 10, as indicated by arrows 19. This rotation provides for the surface of drum 10 and roller 17 to have opposite velocities in their region of propinquity. Developer assembly 16 also includes multicolor toner supply assembly 14, for providing colored toner to develop latent images on photoconductive drum 10.

Multicolor toner supply assembly 14 receives separate supplies of colored toner from four different reservoirs 40, 42, 44 and 46, typically containing Yellow (Y), Magenta (M), Cyan (C) and Black (K) liquid toners respectively. Pumps 48 may be provided at the entrances of respective supply conduits 56, for providing a desired amount of pressure to feed the colored toner to a series of spray nozzles 57.

The above-mentioned multicolor supply assembly 14 and developer assembly 16 are described in greater detail in commonly assigned U.S. patent application Ser. Nos. 7/470,758 filed Jan. 26, 1990, entitled LIQUID DEVELOPER SYSTEM, and 7/570,776 filed Aug. 22, 1990, entitled LIQUID DEVELOPER SYSTEM, the disclosures of which are incorporated herein by reference. Alternative preferred liquid developer assemblies are described in commonly assigned PCT Patent Publication WO 90/14619, the disclosure of which is incorporated herein by reference. While the invention is described herein in the context of the preferred liquid toner developer system, other liquid toner developer systems, as are well known in the art, may be employed.

Photoconductive drum 10, photoconductor charging apparatus 11 and imaging apparatus 12 may be any suitable drum, charging apparatus and imaging apparatus such as are well known in the art.

Excess liquid removal and image compacting assembly 18 typically includes a biased squeegee roller 21 which is urged against drum 10. Squeegee roller 21 is preferably formed of resilient slightly conductive polymeric material, and is charged to a potential of several hundred to a few thousand volts generally with the same polarity as that of the charge on the toner particles.

Intermediate transfer member 20 may be any suitable intermediate transfer member such as those described in commonly assigned U.S. Pat. No. 4,974,027 and U.S. patent application Ser. No. 7/393,649 filed Aug. 14, 1989, the disclosures of which are incorporated herein by reference, and is arranged for electrophoretic transfer of the image thereto from the image bearing surface. Intermediate transfer member 20 is preferably associated with a pressure roller 24 for subsequent transfer of the image onto a final substrate 25, such as paper, preferably by heat and pressure. A fuser 26 may be associated with substrate 25, for fixing the image thereon, if further fixing is required.

Cleaning station 22 may be any suitable cleaning station such as the resilient blade shown in FIG. 1 or that described in U.S. Pat. No. 4,439,035, the disclosure of which is incorporated herein by reference.

In accordance with one embodiment of the invention, after development of each image in a given single color, the single color image is transferred to intermediate transfer member 20. Subsequent images in different colors are sequentially transferred in mutual registration onto intermediate transfer member 20. When all of the desired images have been transferred to intermediate transfer member 20, the complete multi-color image is transferred from intermediate transfer member 20 to substrate 25. Pressure roller 24 preferably produces operative engagement between intermediate transfer member-20 and substrate 25 only when transfer of the composite image to substrate 25 takes place.

Alternatively, each single color image is transferred to substrate 25 via intermediate transfer member 20 after its formation. In this case, the paper is fed through the machine once for each color or is held on a platen (not shown) and contacted with intermediate transfer member 20 during transfer of the single color images to substrate 25. As a further alternative, the intermediate transfer member 20 is omitted and the developed single color images are transferred sequentially directly from drum 10 to substrate 25.

Associated with each of reservoirs 40, 42, 44 and 46 are typically provided dispenser cans 66 of liquid toner concentrate, secured to mounting brackets 68. In a preferred embodiment of the invention, dispenser cans 66 and brackets 68 are constructed and operative as described hereinbelow.

In operation, a measurement responsive to the concentration of toner particles in liquid toner in the respective reservoir is performed preferably by measurement of the optical density of the liquid toner by an optical detector 132. When the density is below a first predetermined level, controller 97 activates air pressure source 222 to add a measured amount of toner concentrate from dispenser can 66 to the respective toner reservoir via a conduit 100 as described hereinbelow, thus increasing the toner particle concentration in the respective toner reservoir. The optical density of each of the colored toner dispersions is preferably separately measured by separate optical density measurement circuits. Exemplary forms of density measurement systems are shown in U.S. Pat. Nos. 4,579,253 and 4,860,924, the disclosures of which are incorporated herein by reference.

Charge director is preferably included with the toner concentrate in a proper amount. A conductivity measuring apparatus (not shown) is provided in each reservoir to determine a low conductivity condition. If a low conductivity condition exists, then a measured amount of charge director solution is added to the specific reservoir. U.S. Pat. No. 4,860,924, the disclosure of which is incorporated herein by reference, shows exemplary apparatus for carrying out the charge director replenishment function.

Each of reservoirs 40, 42, 44 and 46 also typically receives an input of recycled toner of a corresponding color from developer assembly 16, via conduits 150.

The construction and operation of the apparatus for dispensing liquid toner concentrate will now be described with reference to FIGS. 2A, 2B, 3, 4A and 4B.

Each dispenser can 66 comprises a housing 82, which may be of any suitable solid material, such as aluminum or aluminum alloy, and may be similar in construction to the housings of commercially available aerosol spray cans. Preferably, housing 82 is cylindrical in shape, with one end 91 projecting inward and defining a smooth, outward facing concave surface 93, and the opposite end 95 projecting outward and circumscribed with projecting rib 84. At the center of each of the opposite end portions are small bore openings, 86 and 88, enabling communication between the interior and exterior of the housing.

Figure 2A:
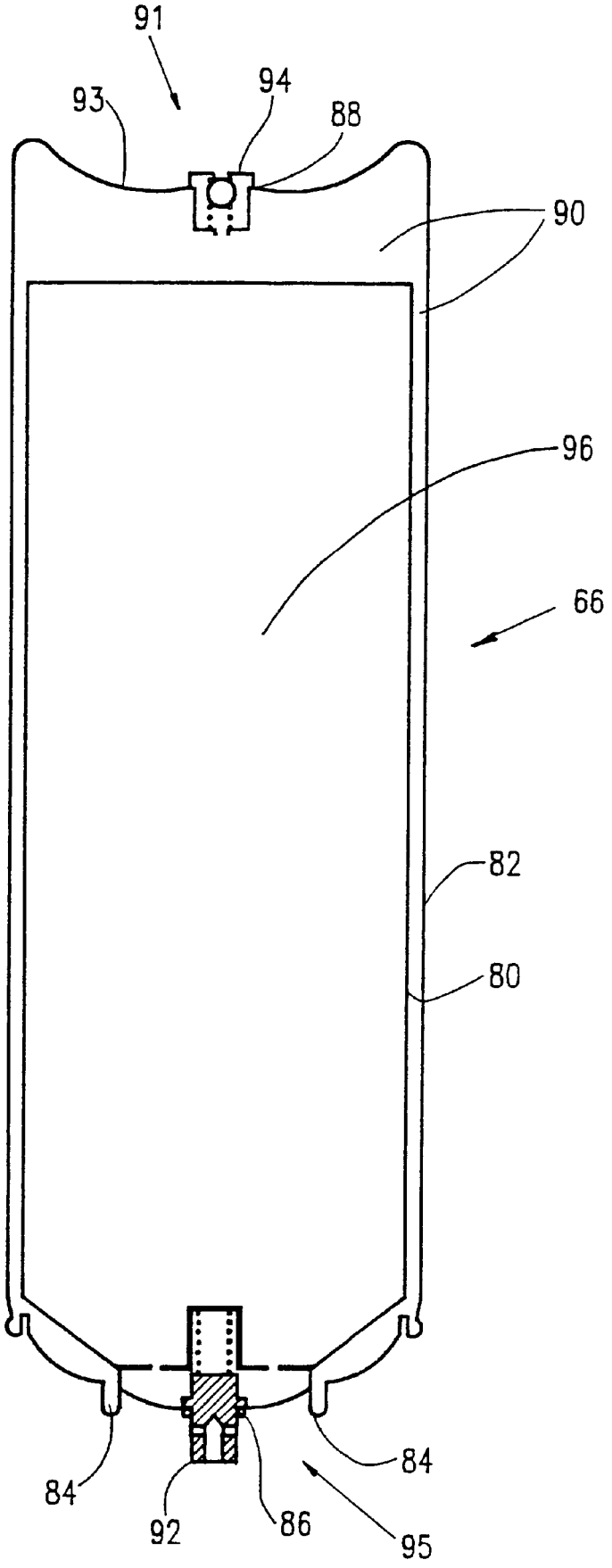
FIG. 2A is a simplified side sectional illustration of a liquid toner concentrate dispenser can constructed in accordance with a preferred embodiment of the invention.
Figure 2B:
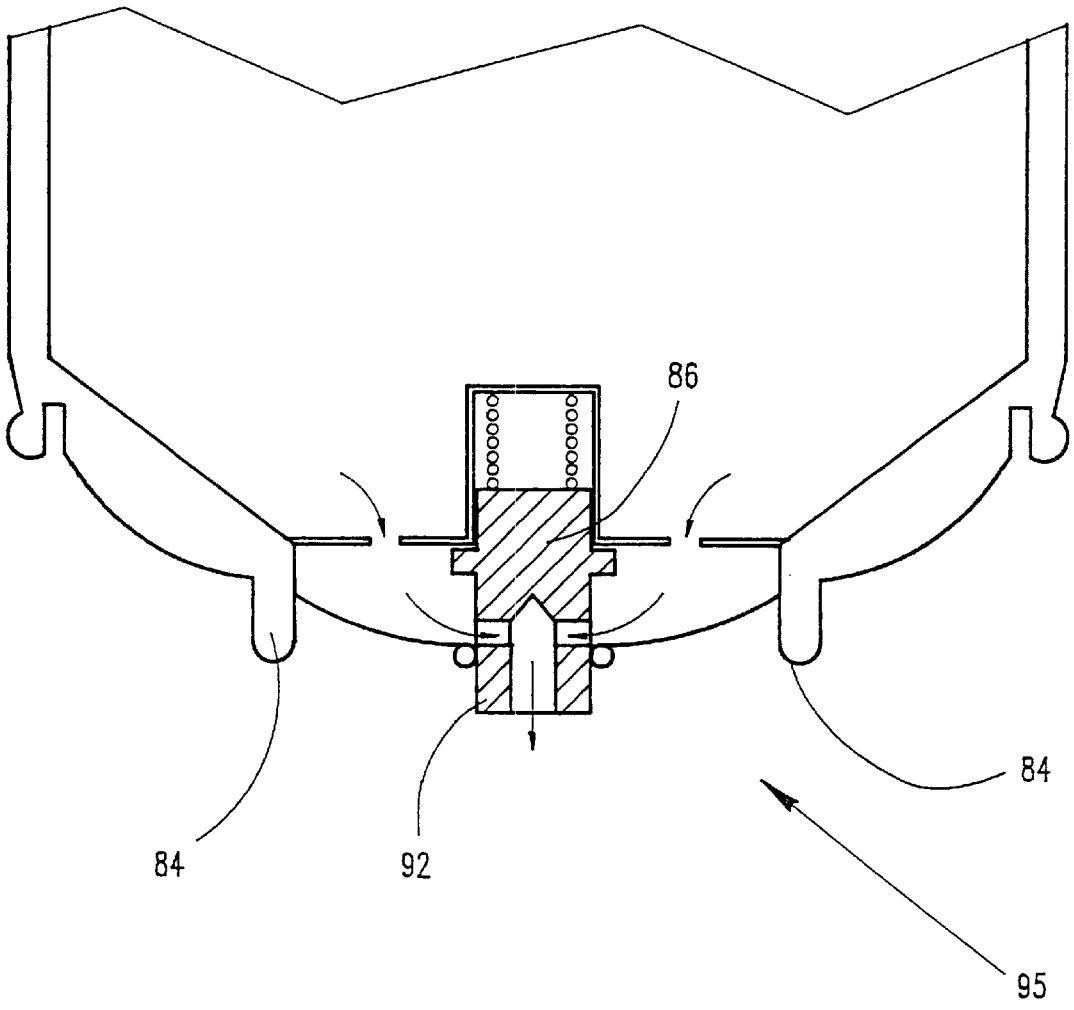
FIG. 2B is an enlarged sectional view of part of the apparatus of FIG. 2A.

Located within housing 82 is a movable divider 80 which separates the internal volume of housing 82 into a first space 96 containing liquid toner concentrate and a second space 90. Divider 80 is made of any suitable solid or flexible material impervious to liquid and may take the form of a plunger or piston, or preferably a flexible envelope as shown. A valve 92 is disposed within communication opening 86 and connects space 96 with the exterior of housing 82. Valve 92 is normally closed as shown in FIG. 2A. When valve 92 is pushed inward, as shown in FIG. 2B, the valve is open, thereby allowing for egress of toner concentrate from space 96 to the exterior of dispenser can 66. A uni-directional valve 94 is disposed within communication opening 88, and is operative to allow air from outside the can into space 90 when the air pressure outside the can is greater than that inside space 90.

Figure 3:
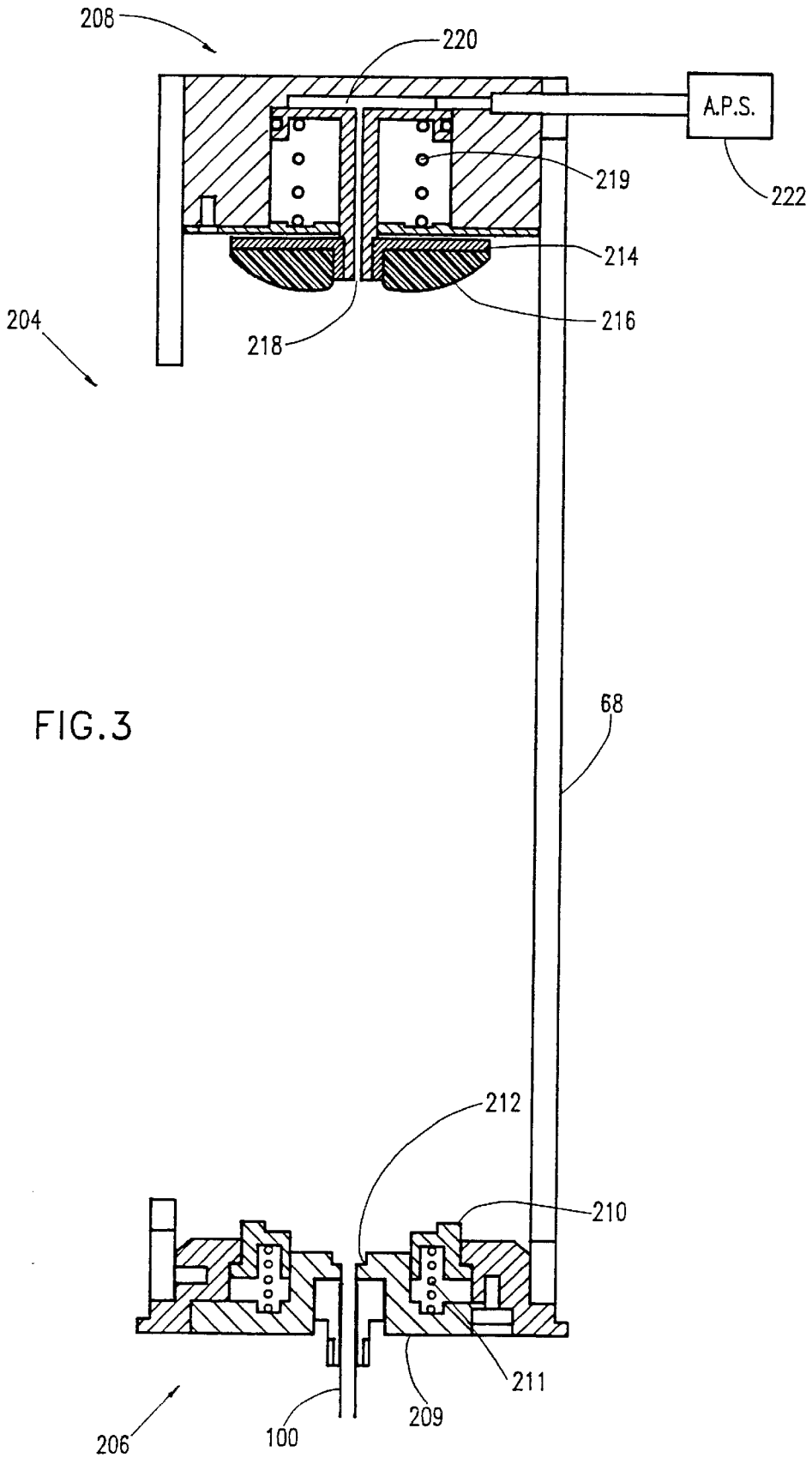
FIG. 3 is a side sectional illustration of a mounting bracket for a liquid toner concentrate dispenser can constructed in accordance with a preferred embodiment of the invention.

Mounting bracket 68, shown more clearly in FIG. 3, is preferably formed of any suitable non-corrosive metal, metal alloy or plastic, is cylindrical in shape with end portions 206 and 208 and is formed with a side aperture 204. End portion 206 has a fixed central portion 209 formed with a small bore opening 212 at its center which is slightly larger in diameter than the diameter of valve 92. Conduit 100 which has a diameter smaller than that of bore opening 212 leads away from the center thereof to its respective liquid toner reservoir. An axially movable cylindrical internal portion 210 is mounted, concentric with conduit 100, on a spring 211. When spring 211 is in its rest position, internal portion 210 is elevated in the direction of opposite end portion 208, as shown in FIG. 3.

End portion 208 has a piston-like axially movable central portion 214 which is mounted on a spring 219. When spring 219 is in its rest position, central portion 214 is at a maximum distance away from opposite end portion 208. Central portion 214 has a small diameter bore opening 218 running through its center and an elastomer pad 216 which is configured to sealingly abut surface 93 of end portion 91 of dispenser can 66. The conduit formed by opening 218 connects with a region 220 which leads to air pressure source 222.

Figure 4A:
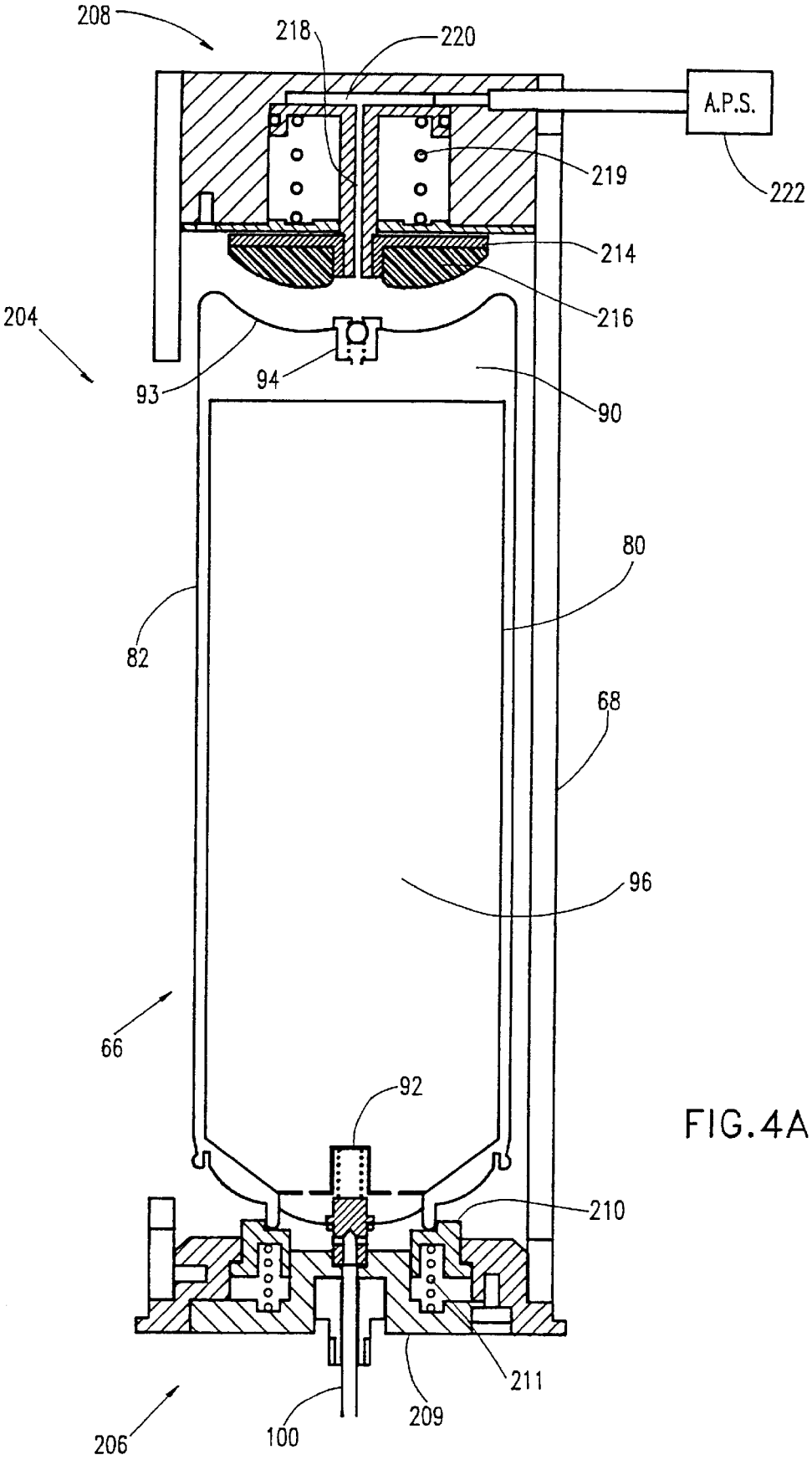
FIGS. 4A and 4B are side sectional illustrations of the liquid toner concentrate dispenser can secured within the mounting bracket, showing the dispenser can in its two operative positions.
Figure 4B:
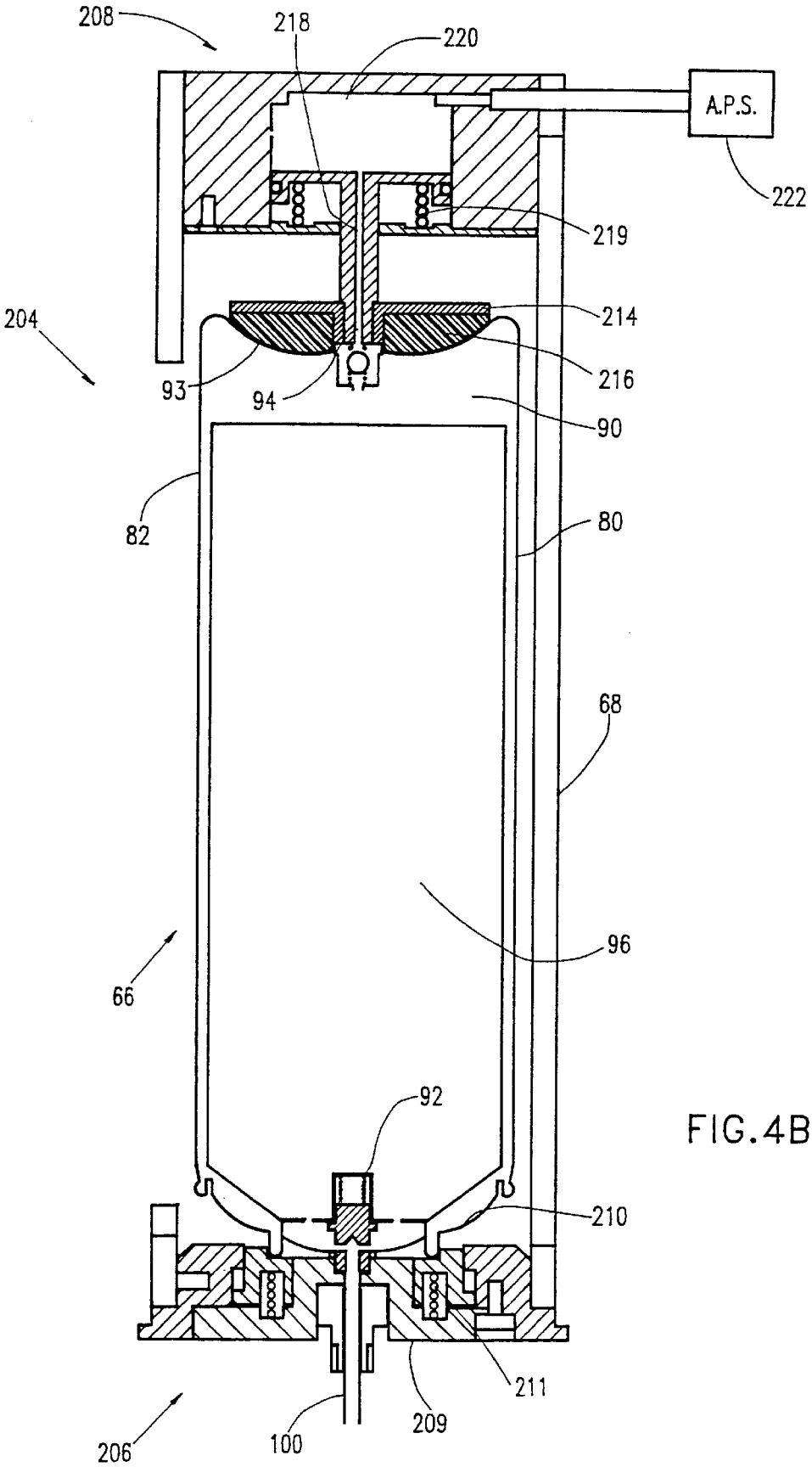

Dispenser can 66 is readily placed within mounting bracket 68 through aperture 204, and is secured therein in the position as shown in FIG. 4A. In such position, valve 92 is not depressed and no egress of toner concentrate is possible. When air-pressure source 222 is activated in response to a signal from controller 97, the following sequence occurs: pressurized air flows from air pressure source 222 into region 220 forcing axial movement of central portion 214 in the direction of opposite end portion 206. Elastomer pad 216 then abuts on surface 93 of end portion 91 of dispenser can 66. Continued activation of the air pressure source causes additional movement of central portion 214, thereby forcing axial movement of dispenser can 66 within mounting bracket 68 until the can reaches the position as shown in FIG. 4B. It will be appreciated that such position is determined by the maximum allowable axial movement of spring mounted internal portion 210 of end portion 206. It will also be appreciated that in such position valve 92 is open, having been depressed upon abutment with the base of bore opening 212, and as a consequence egress of toner concentrate becomes possible.

Continued activation of air pressure source 222 results in an ingress of pressurized air into space 90 within dispenser can 66, through conduit 218 and valve 94. Further ingress of pressurized air into space 90 after valve 92 is open results in a movement of divider 80 in the direction of valve 92, thereby causing a measured egress of toner concentrate from space 96, via a conduit 100 to a respective liquid toner reservoir such as reservoir 44. When operation of air pressure source 222 is suspended, following a signal from controller 97, pressurized air is removed from region 220, but is not removed from interior air space 90 due to the action of uni-directional valve 94. The drop in air pressure within region 220 to the ambient air pressure results in axial movement of dispenser can 66 towards end portion 208, due to the tension release effect of springs 211 and 219, thereby closing valve 92 and returning the can to the position as shown in FIG. 4A.

A preferred toner for use in the present invention is prepared by mixing ten parts of Elvax II 5950T (E.I. du Pont) and five parts of Isopar L (Exxon) at low speed in a jacketed double planetary mixer connected to an oil heating unit set at 130° C. for one hour. 5 parts of Isopar L are added to the mix and the whole is mixed for a further hour at high speed. Ten parts of Isopar L, preheated to 110° C., are added, and mixing is continued without heating until the temperature of the mixture drops to 40° C. Ninety grams of the resultant product is transferred to a 01 attritor (Union Process) together with 7.5 g. of Mogul L (Cabot) and 120 g. Isopar L. The mixture is ground for 24 hours with water cooling (≈20° C.). The resultant toner particles have a median (by weight) diameter of about 2.1 $\mu$m. The resultant material is diluted to a non-volatile solids content of 1.5%, using Isopar L. Charge directors as known in the art are added to charge the toner particles. Preferably, the charge directors described in commonly assigned U.S. patent application Ser. No. 7/354,121, filed May 22, 1989, or U.S. patent application Ser. No. 7/533,765, filed on Jun. 6, 1990, the disclosures of which are incorporated herein by reference, may be used.

Other appropriate liquid toners may alternatively be employed. For colored liquid developers, carbon black is replaced by color pigments as is well known in the art.

It will be appreciated by persons skilled in the art that the present invention is not limited to what has been particularly shown and described hereinabove. Rather the scope of the present invention is defined only by the claims which follow:

What is claimed is:

1. Apparatus for dispensing material such as liquid toner concentrate comprising:

a canister;

a movable partition disposed within the canister, said movable partition defining a first space containing liquid toner concentrate and a second space between the movable partition and the canister;

a first valve communicating with said first space and allowing egress of liquid toner concentrate from said first space when said first valve is activated;

a second valve communicating with said second space and allowing ingress of pressurized fluid into said second space when said second valve is activated;

mounting means operative to secure the canister while allowing for axial movement of the canister; and fluid pressure means for causing axial movement of the canister and selective dispensing of the liquid toner concentrate from the first space.

2. Apparatus according to claim 1, wherein the fluid is air and the fluid pressure means is an air pressure means.

3. Apparatus according to claim 1, wherein the fluid is a gas and the fluid pressure means is a gas pressure means.

4. Apparatus according to claim 3 wherein the gas pressure means is operative to activate the first and second valves thereby to cause said selective dispensing of toner concentrate from the first space.

5. Apparatus according to claim 3 wherein said first valve is a push-type valve which is activated when said first valve is depressed.

6. Apparatus according to claim 5 wherein the gas pressure means activates said first valve by causing displacement of said canister.

7. Apparatus according claim 3 wherein said second valve is a uni-directional pressure valve which is activated when the gas pressure exterior to said second space is greater than the gas pressure within said second space.

8. Apparatus according to claim 7 wherein the gas pressure means forces pressurized gas into said second space via said second valve.

9. Apparatus according to claim 3 wherein the gas pressure means includes a piston in operative association with said canister, wherein activation of said gas pressure means causes axial displacement of said piston and said canister and activation of said first valve.

10. Apparatus according to claim 9 wherein said piston is mounted on a spring which is operative to cause the piston to return to its rest position when the gas pressure means is not activated.

11. Apparatus according to claim 3 wherein the gas pressure means is operative to maintain said canister in a first position wherein said first valve is not activated and in a second position wherein said first valve is activated.

12. Apparatus according to claim 11 wherein the gas pressure means includes a counter-spring in operative association with said canister, which is operative to cause the canister to return to said first position when the gas pressure means is not activated.

13. Apparatus according to claim 3 wherein said canister is a rigid enclosure having first and second communication openings in opposite end portions thereof, said first valve being disposed in said first communication opening and said second valve being disposed in said second communication opening.

14. Apparatus according to claim 3 wherein said movable partition is a flexible envelope.

15. Apparatus according to claim 3 wherein the first valve is an axial push valve which is activated when it is displaced in along the path of egress of the toner concentrate.

16. Apparatus according to claim 15 wherein gas pressure means activates the first valve by causing axial displacement of the container.

17. Apparatus according to claim 15 wherein the gas pressure means includes a piston in operative association with said canister, wherein activation of said gas pressure means causes axial displacement of said piston and said canister and activation of said first valve.

18. A dispensing container for dispensing a material such as liquid toner concentrate comprising:

a canister;

a movable partition disposed within the canister, said movable partition defining a first space containing liquid toner concentrate and a second space between the movable partition and the canister;

a first valve communicating with said first space for allowing egress of material from said first space when said first valve is activated; and a second valve communicating with said second space for allowing ingress of pressurized fluid into said second space when said second valve is activated; wherein the canister is a rigid enclosure having first and second communication openings in the opposite end portions thereof, said first valve being disposed within said first communication opening and said second valve being disposed within said second communication opening.

19. A dispensing container according to claim 18 wherein said movable partition comprises a flexible envelope.

20. A dispenser container according to claim 18 wherein said first valve is an axial push-type valve which is activated when said first valve is depressed parallel to the path of egress of the toner concentrate from the container.

21. A dispenser container according to claim 18 wherein said second valve is a one-way pressure valve which is activated when the fluid pressure exterior to said canister is greater than the fluid pressure within said second space.

22. A dispenser container according to claim 21 wherein said fluid is a gas.

23. A dispenser container according to claim 21 wherein said fluid is air.

24. A dispenser container according to claim 18 wherein said fluid is a gas.

25. A dispenser container according to claim 18 wherein said fluid is air.

* * * * *